US007164851B2

(12) United States Patent
Sturm et al.

(10) Patent No.: US 7,164,851 B2
(45) Date of Patent: Jan. 16, 2007

(54) MODULAR TANKLESS WATER HEATER CONTROL CIRCUITRY AND METHOD OF OPERATION

(76) Inventors: William R. Sturm, 8757 S. Mill Ave., Tempe, AZ (US) 85284; Joseph M. Sullivan, 517 W. Ensueno Ct., Gilbert, AZ (US) 85233; Thomas J. Shortland, 6916 Butte Ave., Tempe, AZ (US) 85283; Kevin Hay, 14817 N. Fairlynn Dr., Fountain Hills, AZ (US) 85268; Gregg C. Johnson, 9630 W. Rimrock Dr., Peoria, AZ (US) 85382

( * ) Notice: Subject to any disclaimer, the term of this patent is extended or adjusted under 35 U.S.C. 154(b) by 0 days.

(21) Appl. No.: 11/080,120

(22) Filed: Mar. 15, 2005

(65) Prior Publication Data

US 2006/0222349 A1 Oct. 5, 2006

(51) Int. Cl.
*F24H 9/20* (2006.01)

(52) U.S. Cl. ..... 392/463; 392/466; 219/497

(58) Field of Classification Search ..... None
See application file for complete search history.

(56) References Cited

U.S. PATENT DOCUMENTS 4,436,983 A * 3/1984 Solobay ..... 392/490
5,216,743 A * 6/1993 Seitz ..... 392/490
6,389,226 B1 * 5/2002 Neale et al. ..... 392/485

* cited by examiner

*Primary Examiner*—Thor S. Campbell
(74) *Attorney, Agent, or Firm*—Parsons & Goltry; Robert A. Parsons; Michael W. Goltry

(57) ABSTRACT

Control circuitry is disclosed for use with a tankless water heater system including a plurality of water conduits connected in series. The control circuitry includes a plurality of water heater elements, one each associated with each of the plurality of water conduits. A controller includes a central processing unit (CPU) with an operating program and each of the plurality of water heater elements are coupled to the CPU. The CPU is programmed to individually activate one of the water heater elements to a predetermined power level in response to a demand for heated water. The number of water heater elements activated and the power level of the activation is determined by the demand for heated water.

24 Claims, 13 Drawing Sheets

| POWER LEVEL | HEATER A | HEATER B | HEATER C | HEATER D |
|---|---|---|---|---|
| 0 | 0.00% | 0.00% | 0.00% | 0.00% |
| 1 | 12.50% | 0.00% | 0.00% | 0.00% |
| 2 | 25.00% | 0.00% | 0.00% | 0.00% |
| 3 | 37.50% | 0.00% | 0.00% | 0.00% |
| 4 | 50.00% | 0.00% | 0.00% | 0.00% |
| 5 | 75.00% | 0.00% | 0.00% | 0.00% |
| 6 | 75.00% | 0.00% | 0.00% | 0.00% |
| 7 | 75.00% | 12.50% | 0.00% | 0.00% |
| 8 | 75.00% | 25.00% | 0.00% | 0.00% |
| 9 | 75.00% | 37.50% | 0.00% | 0.00% |
| 10 | 75.00% | 50.00% | 0.00% | 0.00% |
| 11 | 75.00% | 62.50% | 0.00% | 0.00% |
| 12 | 75.00% | 75.00% | 0.00% | 0.00% |
| 13 | 75.00% | 75.00% | 12.50% | 0.00% |
| 14 | 75.00% | 75.00% | 25.00% | 0.00% |
| 15 | 75.00% | 75.00% | 37.50% | 0.00% |
| 16 | 75.00% | 75.00% | 50.00% | 0.00% |
| 17 | 75.00% | 75.00% | 62.50% | 0.00% |
| 18 | 75.00% | 75.00% | 75.00% | 0.00% |
| 19 | 75.00% | 75.00% | 75.00% | 12.50% |
| 20 | 75.00% | 75.00% | 75.00% | 25.00% |
| 21 | 75.00% | 75.00% | 75.00% | 37.50% |
| 22 | 75.00% | 75.00% | 75.00% | 50.00% |
| 23 | 75.00% | 75.00% | 75.00% | 75.00% |
| 24 | 75.00% | 75.00% | 75.00% | 75.00% |
| 25 | 87.50% | 75.00% | 75.00% | 75.00% |
| 26 | 87.50% | 87.50% | 75.00% | 75.00% |
| 27 | 87.50% | 87.50% | 87.50% | 75.00% |
| 28 | 87.50% | 87.50% | 87.50% | 87.50% |
| 29 | 100.00% | 87.50% | 87.50% | 87.50% |
| 30 | 100.00% | 100.00% | 87.50% | 87.50% |
| 31 | 100.00% | 100.00% | 100.00% | 87.50% |
| 32 | 100.00% | 100.00% | 100.00% | 100.00% |

FIGURE 13

MODULAR TANKLESS WATER HEATER CONTROL CIRCUITRY AND METHOD OF OPERATION

FIELD OF THE INVENTION

This invention relates to water heater controls.

More particularly, the present invention relates to controls for water heaters employing resistive heating elements.

More particularly, the present invention relates to methods of operating a controller for water heaters.

BACKGROUND OF THE INVENTION

The need for heated fluids, and in particular heated water, has long been recognized. Conventionally, water has been heated by heating elements, either electrically or with gas burners, while stored in a tank or reservoir. While effective, energy efficiency and water conservation can be poor. As an example, water stored in a hot water tank is maintained at a desired temperature at all times. Thus, unless the tank is well insulated, heat loss through radiation can occur, requiring additional input of energy to maintain the desired temperature. In effect, continual heating of the stored water is required. Additionally, the tank is often positioned at a distance from the point of use, such as the hot water outlet. In order to obtain the desired temperature water, cooled water in the conduits connecting the point of use (outlet) and the hot water tank must be purged before the hot water from the tank reaches the outlet. This can often amount to a substantial volume of water.

Many of these problems have been overcome by the use of tankless water heaters. However, heating water accurately and efficiently in a consistent and safe manner can be problematic with current tankless systems. It is, for example, difficult and highly inefficient to heat water to a desired useable state each time hot water is used. Applying full power to heating elements for short periods and randomly is very fatiguing on components and causes substantial wear and degradation. Further, in many prior art types of water heaters the water is over heated, too much water is heated, or the water is heated above a maximum desired temperature all of which wastes power and adds to the eventual deterioration of the system.

It would be highly advantageous, therefore, to remedy the foregoing and other deficiencies inherent in the prior art.

Accordingly, it is an object the present invention to provide a new and improved control circuitry for tankless water heaters.

It is another object of the present invention to provide control circuitry for tankless water heaters that more closely controlls the temperature of the water during usage.

It is another object of the present invention to provide control circuitry for tankless water heaters that more closely provides a desired amount of water at a desired temperature.

SUMMARY OF THE INVENTION

Briefly, to achieve the desired objects of the present invention in accordance with a preferred embodiment thereof provided is a control circuitry for use with a tankless water heater system including a water heater module with a plurality of water conduits connected in series. The control circuitry includes a plurality of water heater elements, one each associated with each of the plurality of water conduits. A controller includes a central processing unit (CPU) with an operating program and each of the plurality of water heater elements are coupled to the CPU. The CPU is programmed to individually activate one of the water heater elements to a predetermined power level in response to a demand for heated water. The number of water heater elements activated and the power level of the activation is determined by the demand for heated water.

In a specific embodiment, control circuitry for a tankless water heater system is disclosed. The tankless water heater system includes a water heater module with four water conduits connected in series, the series connection being further connectable to a cold water supply and to provide a heated water flow to a heated water demand site. The control circuitry includes four water heater elements, one each associated with each of the plurality of water conduits. A controller in the control circuitry includes a CPU programmed with an operating program. A plurality of sensors are positioned in the water flow and electrically coupled to the controller with at least one of the plurality of sensors providing an indication of the water temperature in an outlet of the series connection. Connecting and operating circuitry couples each of the plurality of water heater elements to the CPU. The CPU is programmed to control the connecting and operating circuitry in accordance with indications from the plurality of sensors to individually activate a first water heater element to a first power level for a first heat required in response to a demand for heated water. For heat required greater than the first heat required and less than a second heat required in response to a demand for heated water the CPU increases the power level of the first water heater element in predetermined increments.

The CPU is programmed to control the connecting and operating circuitry in accordance with indications from the plurality of sensors to individually activate a second water heater element of the four water heating elements to the first power level for the second heat required. For heat required greater than the second heat required and less than a third heat required in response to a demand for heated water the CPU increases the power level of the second water heater element in predetermined increments. The CPU is also programmed to individually activate a third water heater element of the four water heater elements to the first power level for the third heat required. For heat required greater than the third heat required and less than a fourth heat required in response to a demand for heated water the CPU increases the power level of the third water heater element in predetermined increments. The CPU is also programmed to individually activate a fourth water heater element of the four water heater elements to the first power level for the fourth heat required. For heat required greater than the fourth heat required and less than a fifth heat required in response to a demand for heated water the CPU increases the power level of the fourth water heater element in predetermined increments.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which:

FIG. 13 is a chart illustrating a preferred embodiment of power usage in accordance with the present invention.

DETAILED DESCRIPTION OF A PREFERRED EMBODIMENT

Figure 1:
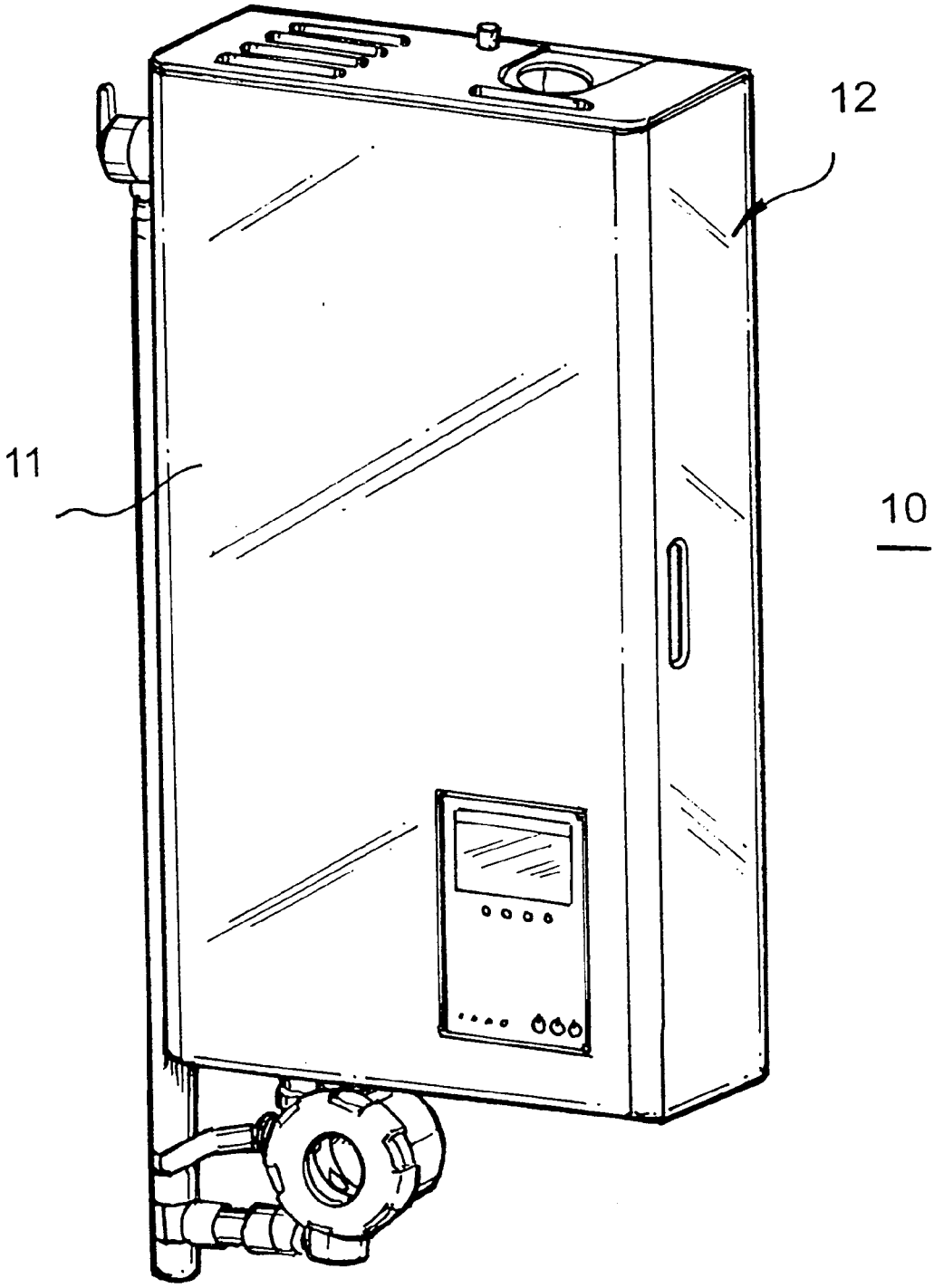
FIG. 1 is a perspective view of the tankless water heater system.

Turning now to the drawings in which like reference characters indicate corresponding elements throughout the several views, attention is directed to FIG. 1 which illustrates a tankless water heater system generally designated 10 that can be used in conjunction with the present control circuitry. Tankless water heater 10 is described in more detail in a copending United States Patent Application entitled "Modular Tankless Water Heater" filed of even date herewith and incorporated herein by reference. System 10 includes a housing 12 closed by a cover 11. Tankless water heater system 10 is a system which heats water as its flows through. Electrical power is conserved by heating water only as it is needed. As water needs are increased, increasing amounts of energy are added to the flowing water to reach a desired temperature.

Figure 2:
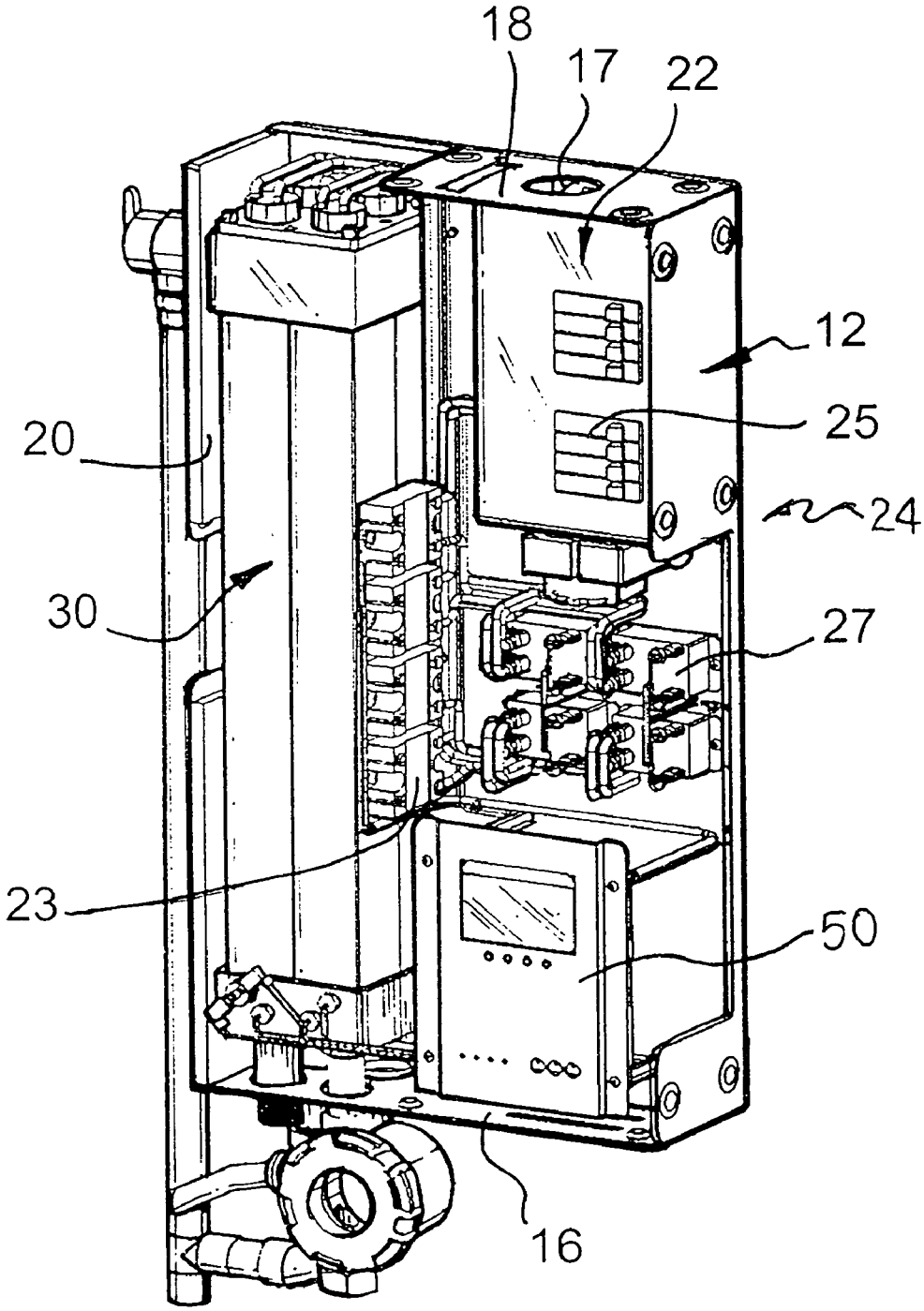
FIG. 2 is a perspective view of the tankless water heater system with the cover removed.
Figure 3:
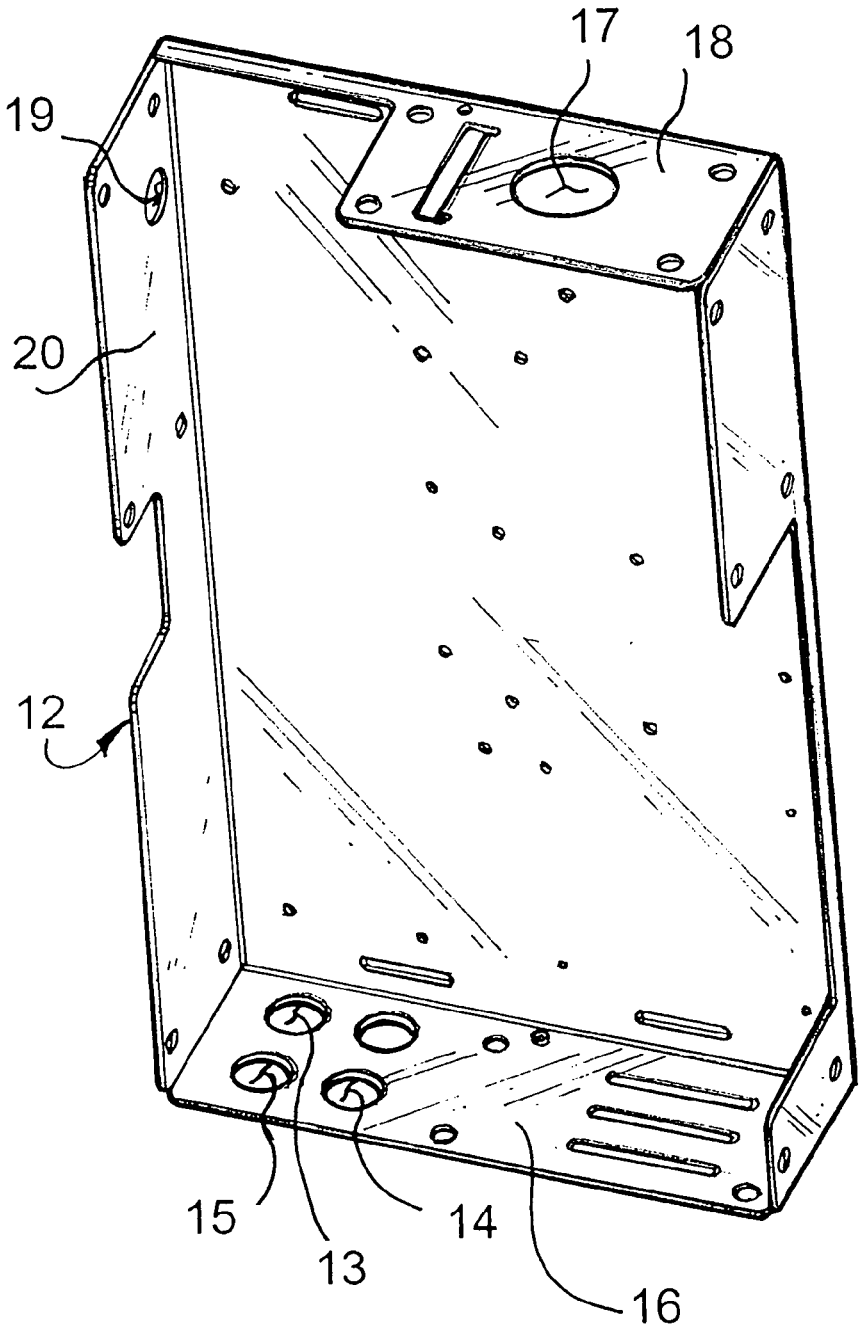
FIG. 3 is a perspective view of the housing of the tankless water heater.

Referring to FIGS. 2 and 3, housing 12 acts as a support structure for the various components of system 10, and includes a flush aperture 13, an inlet aperture 14 and an outlet aperture 15, each formed through a bottom sidewall 16. A power inlet 17 is formed in a top sidewall 18, and a safety valve aperture 19 is formed in a sidewall 20 extending perpendicularly between bottom sidewall 16 and top sidewall 18. Housing 12 carries a power module 22 with associated solid-state relay switches 27, a controller 50, and a water heater module 30 with associated solid state relay switches (SSR) 23. For purposes of this description and clarity of orientation of the various elements, bottom is a term which will be used in conjunction with a direction toward bottom sidewall 16 of housing 12, and top is a term which will be used in conjunction with a direction toward top sidewall 18 of housing 12. It will be understood by those skilled in the art that housing 12 can be oriented to the surrounding environment in substantially any way, with, for example, bottom sidewall 16 oriented to the side, bottom or top.

Power module 22 includes a terminal and breaker switch combination 25 to provide safety and reduce associated elements needed for installation. No separate or outside breaker box is necessary for the installation of system 10. Controller 50 receives water flow and water temperature data, controlling water heater module 30 by actuating solid-state relay switches 23. System 10, in the preferred embodiment, also includes mechanical relays 27, which act as safety shut-offs when a predetermined temperature is equaled or exceeded. These relays are coupled to controller 50 only for sensing information but are mechanically independent therefrom. Electrical power runs from breakers 25 through mechanical relays 27 to solid state relays 23. When signaled from controller 50, solid-state relay switches 23 provide power to module 30.

Figure 4:
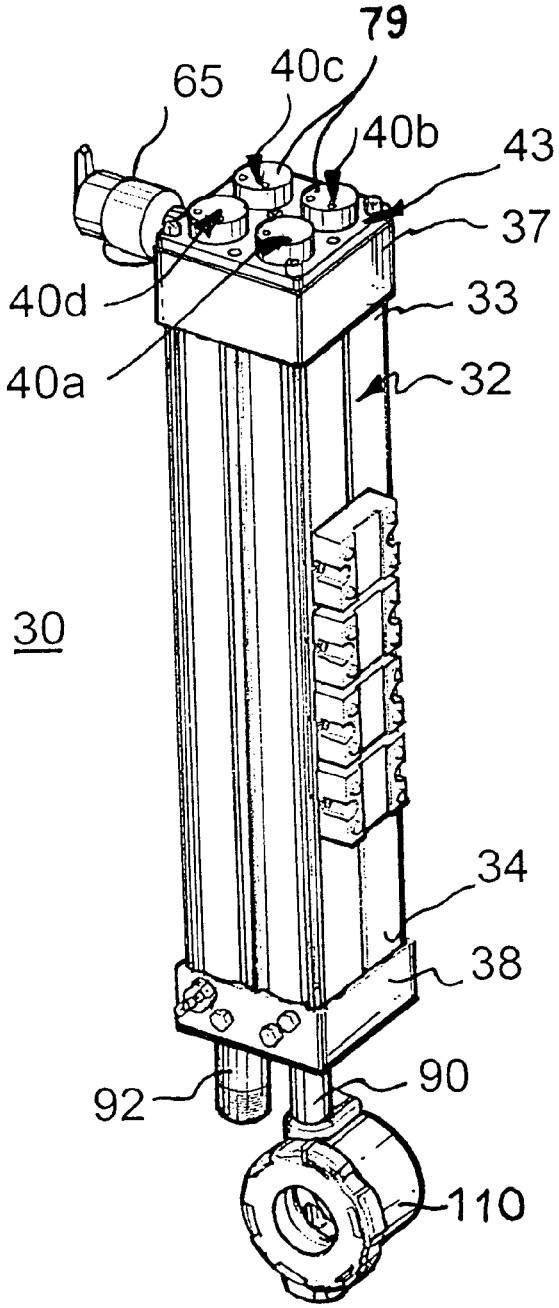
FIG. 4 is a perspective view of the tankless water heater module.

Turning now to FIG. 4, water heater module 30 includes a casing 32 which includes a top end 33, a bottom end 34, and a plurality of conduits 35 extending therethrough from top end 33 to bottom end 34. In the preferred embodiment, four conduits 35*a*, 35*b*, 35*c*, and 35*d* are employed, although more or less can be used. It has been found that four is the optimal number, with greater capacity achieved by employing additional modules, as will be described presently. A top head manifold 37 is coupled to top end 33 and a bottom head manifold 38 is coupled to bottom end 34. Heating elements 40 extend through top head manifold 37 into conduits 35. Conduits 35 are sized sufficient to receive heating elements 40 therein, preferably without contact between heating elements 40 and the side of the respective conduit 35. In this embodiment, four heating elements 40*a*, 40*b*, 40*c*, and 40*d* are employed, one for each conduit 35*a–d*, respectively. The four solid-state relay switches 23*a*, 23*b*, 23*c*, and 23*d* are electrically coupled to provide power to the four the four heating elements 40*a*, 40*b*, 40*c*, and 40*d* in response to signals from controller 50. As can be seen, casing 32 is generally square in cross-section, with a conduit 35 positioned in each quadrant of the square cross-section. In this configuration, each conduit 35 shares two sides with adjacent conduits. The result of this orientation is to reduce the footprint of water heater module 30 and to conserve heat within the unit. As will become apparent in the ongoing description, heat radiating from one conduit will radiate into adjacent conduits thereby reducing heat loss and increasing efficiency. Due to its unique shape, casing 32 can be constructed in a variety of manners, including extrusion molding. By employing extrusion molding, fabrication costs can be greatly reduced.

Figure 5:
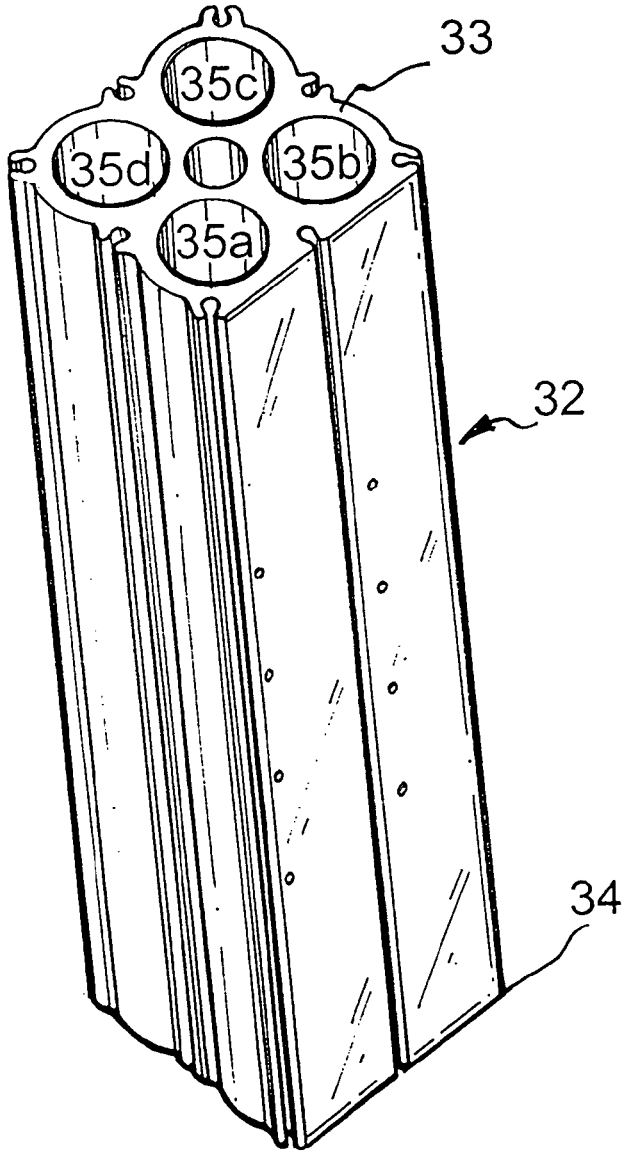
FIG. 5 is a perspective view of the casing of the tankless water heater module.

Turning now to FIG. 4, with additional reference to FIG. 5, water heater module 30 includes a casing 32 which includes a top end 33, a bottom end 34, and a plurality of conduits 35 extending therethrough from top end 33 to bottom end 34. In the preferred embodiment, four conduits 35*a*, 35*b*, 35*c*, and 35*d* are employed, although more or less can be used. It has been found that four is the optimal number, with greater capacity achieved by employing additional modules, as will be described presently. A top head manifold 37 is coupled to top end 33 and a bottom head manifold 38 is coupled to bottom end 34. Heating elements 40 extend through top head manifold 37 into conduits 35. Conduits 35 are sized sufficient to receive heating elements 40 therein, preferably without contact between heating elements 40 and the side of the respective conduit 35. In this embodiment, four heating elements 40*a*, 40*b*, 40*c*, and 40*d* are employed, one for each conduit 35*a–d*, respectively. As can be seen, casing 32 is generally square in cross-section, with a conduit 35 positioned in each quadrant of the square cross-section. In this configuration, each conduit 35 shares two sides with adjacent conduits, which results in a reduce footprint of water heater module 30 and conservation of heat within the unit.

Figure 6:
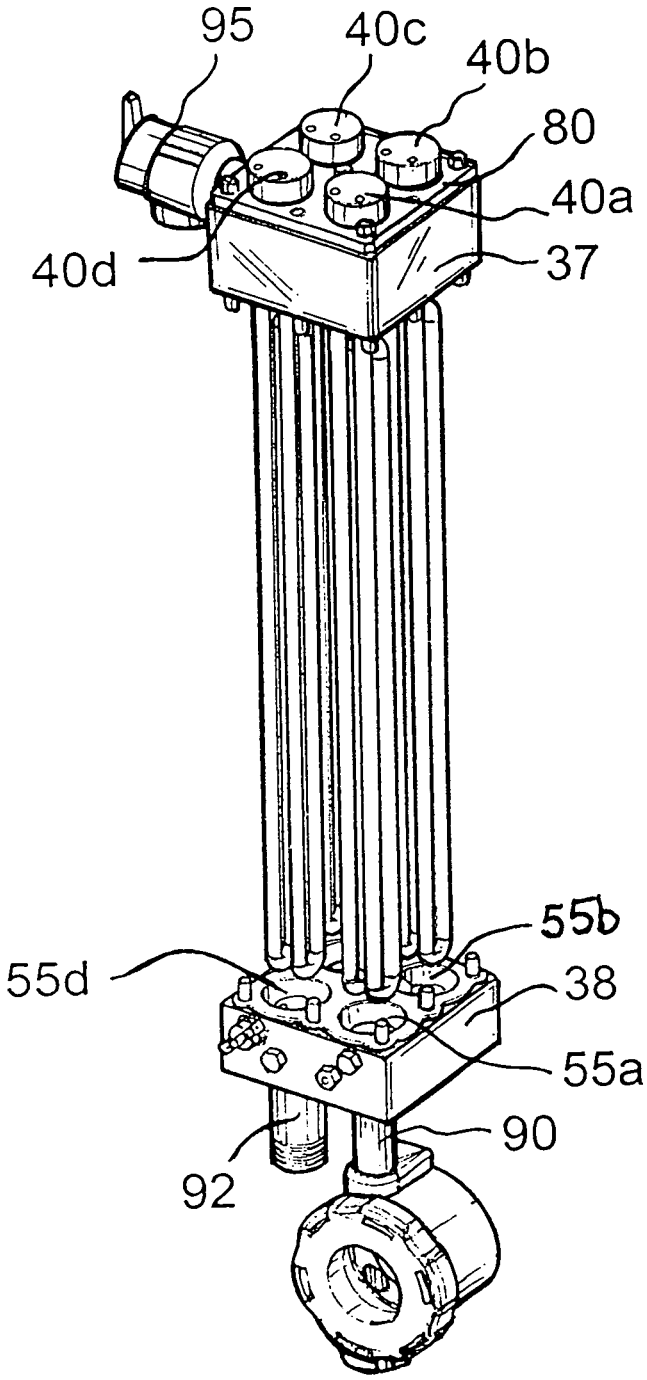
FIG. 6 is a perspective view of the tankless water heater module of FIG. 4 with the casing removed.

Referring now to FIG. 6, water heater module 30 is illustrated without casing 32 to facilitate the description of the placement of heating elements 40 and the operation of top head manifold 37 and bottom head manifold 38. Heating elements 40*a*, 40*b*, 40*c*, and 40*d* are each received through ports of top head manifold 37, extend through four conduits 35*a* through 35*d* of casing 32 and terminate proximate ports 55*a*, 55*b*, 55*c*, and 55*d*, respectively, of bottom head manifold 38.

Heating elements 40 are secured in position within the ports of top head manifold 37 generally by some form of removable engagement mechanism. The purpose for providing an easily disengagable engagement between heating elements 40 and the ports is to permit quick and easy exchange of heating elements 40. Heating elements 40 can have greater or lesser heating capability. Thus, if higher temperatures, greater flow rates or just larger volumes of water are desired, higher output heating elements 40 can replace lower output elements in water heater modules 30. Also, in case of failure or reduced capabilities of one or more heating elements 40, easy and quick replacement is desirable.

As an example, a water heater system 10 having a single module 30 is installed at a location. Over time, larger volumes of water are used, increasing the flow rate of water through water heater module 30 and maxing out its performance. Instead of having to replace the entire module to upgrade the performance, the lower capacity heating elements are replaced with greater capacity elements. At some point, if performance needs to increase past the level of replacing heating elements, additional water heater modules can be installed to expand the system, as will be described presently.

Figure 7:
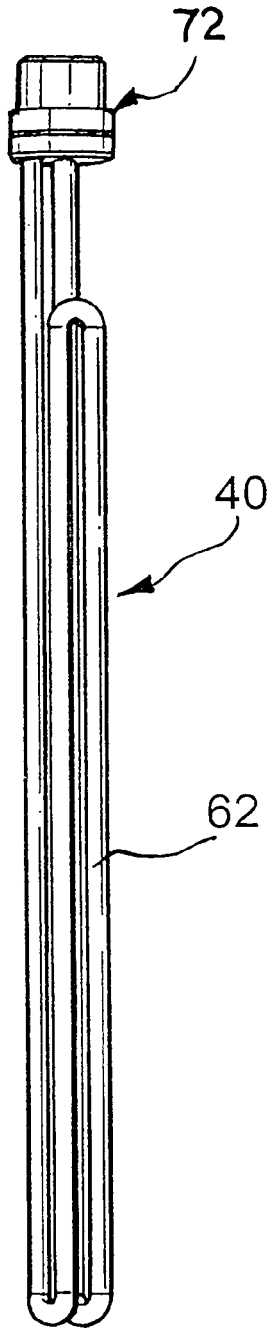
FIG. 7 is a perspective view of a heating element used in the tankless water heater module with a portion of the element coupling assembly.
Figure 8:
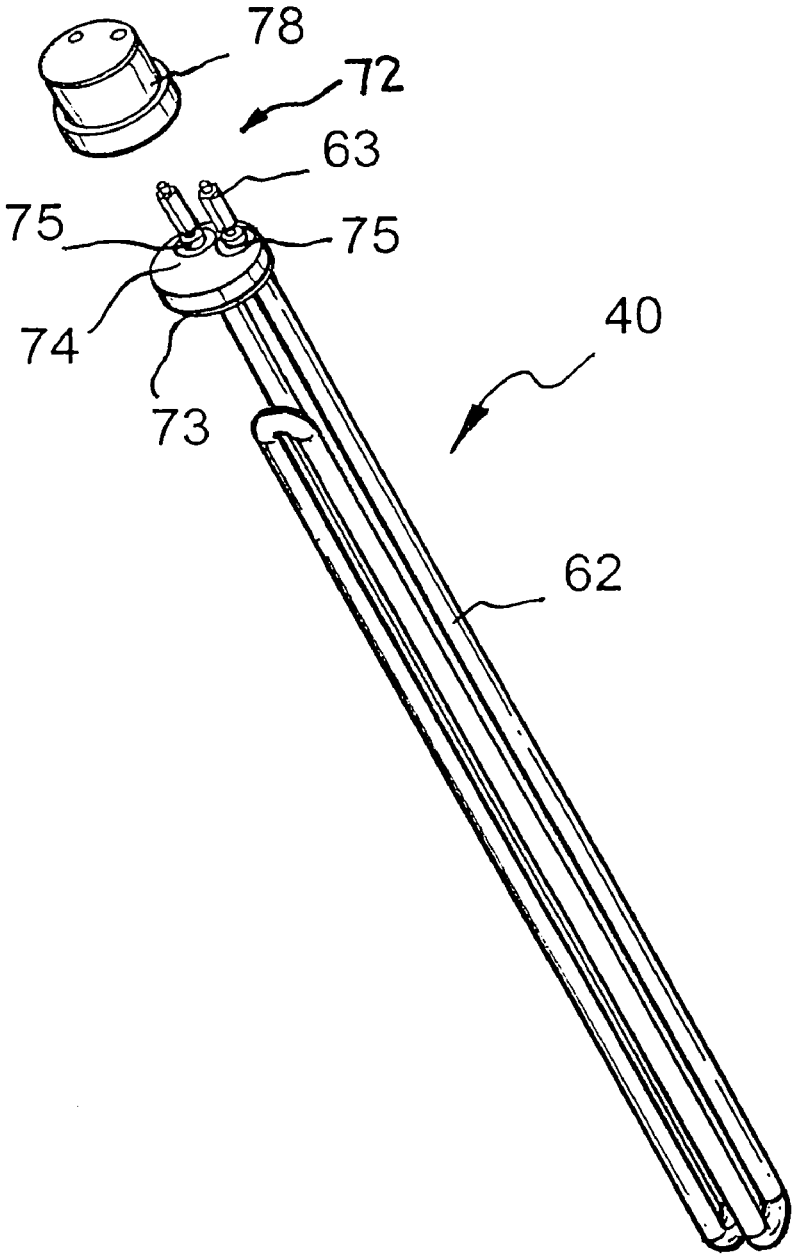
FIG. 8 is a perspective view of the heating element of FIG. 7, with a portion of the element coupling assembly exploded therefrom.

With reference to FIGS. 7 and 8, each heating element 40 is an elongated resistive heating element 62 terminating in leads 63. In this embodiment an element coupling assembly couples each heating element 40 to top head manifold 37 and provides safe connection between power module 22 and heating elements 40. The element coupling assembly includes a cap assembly 72 carried by leads 63 of each heating element 40, and for purposes of this disclosure, is considered a part thereof. Cap assembly 72 includes an O-ring 73, a seal housing 74 holding seals 75, and a compression cap 78. Leads 63 are received through O-ring 73 carried by seal housing 74 and into apertures 79 formed through compression cap 78. With additional reference to FIGS. 4 and 5, heating elements 40 are inserted through top head manifold 37, into casing 32. The element coupling assembly is employed to securely retain each heating element 40, providing touch safety and coupling each heating element 40 to top head manifold 37. The element coupling assembly includes cap assemblies associated with each heater element 40, and a keeper plate. The element coupling assembly permits removal of any or all heating elements 40*a–d* by simply removing the keeper plate. Additionally, the cap assemblies prevent accidental or inadvertent contact with leads 63, providing added safety.

Referring back to FIGS. 4, 5, and 6, a water supply inlet 90 is coupled to port 55*a* of bottom head manifold 38. A hot water supply outlet 92 is coupled to port 55*d* of bottom head manifold 38. Water flow through conduits 35 is facilitated by top head manifold 37 and bottom head manifold 38. Water enters water heater module 30 from water supply inlet 90 through port 55*a* and into conduit 35*a*. Water flows from conduit 35*a* through a port and horizontal channel to an adjacent port of top head manifold 37 and into conduit 35*b*. Water flow continues from conduit 35*b* through port 55*b*, a horizontal channel, and port 55*c* of bottom head manifold 38 into conduit 35*c*. Finally, in this four conduit embodiment, water flows from conduit 35*c* through port 45*c*, another horizontal channel and adjacent port of top head manifold 37 into conduit 35*d*. From conduit 35*d*, the water exits water heater module 30 through port 55*d* and into hot water supply outlet 92 to be used as desired. In this manner, the temperature of the water can be adjusted relative the flow rate by the number of heating elements 40 powered and to the extent they are powered.

As can be understood from the description, top head manifold 37 and bottom head manifold 38 permit conduits 35 to share much of the thermal energy generated by heating elements 40 instead of radiating the energy to the surrounding environment. Additionally, while a distinct flow path sequentially through conduits 35 having heating elements 40 is provided, top head manifold 37 and bottom head manifold 38 cooperate to form a single container with respect to pressure water heater module 30. Due to this unique characteristic, a pressure relief valve 95 can be employed for increased safety. Pressure relief valve 95 is coupled to side port 47 of top head manifold 37.

Figure 9:
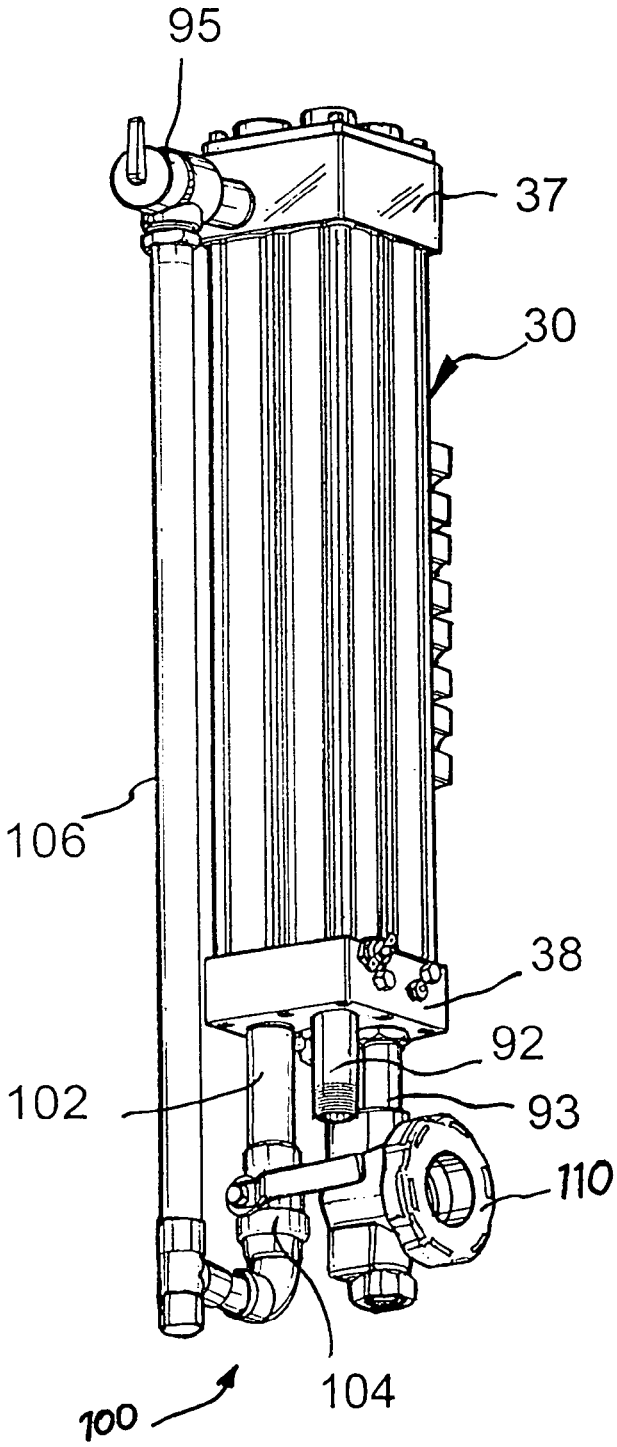
FIG. 9 is a perspective view of the tankless water heater module with flush mechanism.

As briefly mentioned previously, a flush mechanism 100 can be added to the system if desired as shown in FIG. 9. Flush mechanism 100 can be attached to either of the remaining ports 55*b* or 55*c* of bottom head manifold 38. In the embodiment illustrated, the cap is removed from port 55*c* and a flush conduit 102 is connected thereto. A valve 104 is coupled to conduit 102 permitting opening and closing thereof to flush water from tankless water heater system 10, and module 30 specifically. Valve 104 can be manually operated or include a solenoid or similar device for automatic operation, as will be described in more detail presently. Flush conduit 102 can tie into a disposal or drain pipe as available, and can be coupled to a conduit 106 extending from pressure relief valve 95.

Figure 10:
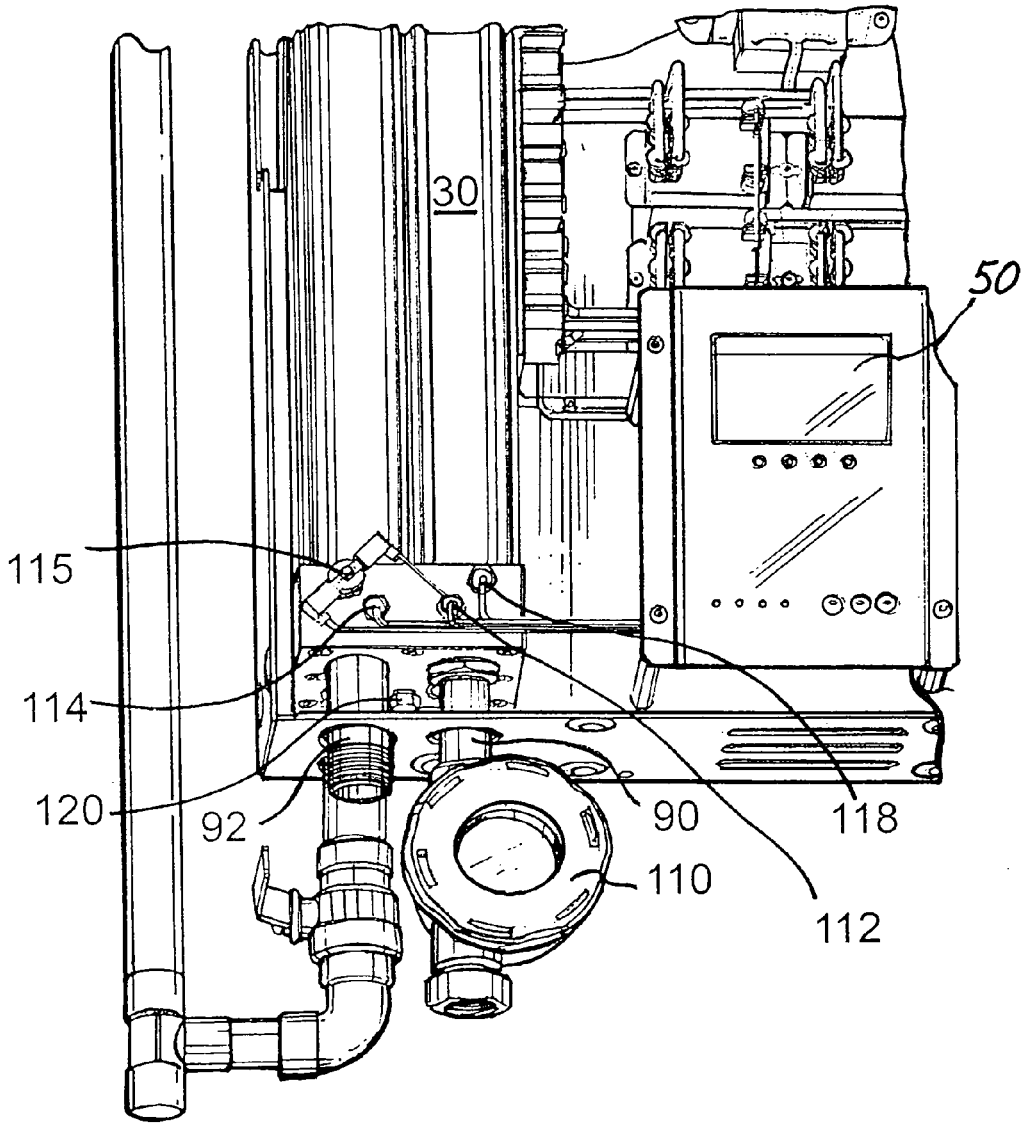
FIG. 10 is an enlarged partial view of the tankless water heater system, illustrating sensors used therein.

With reference to FIG. 10, data is provided to controller 50, by a flow sensor 110 carried by water supply inlet 90. In this embodiment, flow sensor 110 is a paddle wheel pulse flow sensor which allows the volume of water entering water heater module 30 to be measured. Inlet water temperature is sensed by an inlet temperature sensor 112 inserted into port 55*a* through an aperture provided for that purpose. Outlet water temperature is sensed by outlet temperature sensor 114 inserted into port 55*d* through an aperture provided for that purpose. Temperature sensors 112 and 114 allow the temperature of water entering and exiting water heater module 30 to be measured. While sensors 112 and 114 are inserted into the flow path, it will be understood that temperature sensors outside the flow path can be employed. As an example, RTD (radiant thermal device) band sensors can be coupled to the inlet and the outlet to determine temperature. This data is employed by controller 50 to activate one or more heating elements 40, and adjust the power to each element activated through solid state relay switches 23. Control and adjustment of the operation of heating elements 40 is controlled by software within controller 50, as will be explained in more detail presently.

A temperature control sensor 115 is inserted into port 55*d* through an aperture provided for that purpose. Temperature control sensor 115 senses outlet water temperatures exceeding a specific temperature. When temperatures equal to or exceeding a predetermined temperature are detected, over temperature sensor 115 cuts power to mechanical relays 27, preventing power from reaching relays 23. This circuit is a safety which bypasses controller 50 and shuts down heating elements 40 even if controller 50 signals relays 23 to apply power. A grounding lug 118 is inserted into port 55*a* through aperture 56*b*. Grounding lug 118 permits grounding of the electronic components with module 30.

Still referring to FIG. 10, a flow sensor 120 can be added as an addition to or replacement for flow sensor 110. In some instances, the velocity of in flowing water can be at a low level that is difficult to accurately sense. If this is the case, for example, due to large volumes resulting in low velocities, a ribbon flow sensor can be inserted into a channel of bottom head manifold 38 through an aperture provided for that purpose. If flow velocities are low enough to cause a detection problem, the channel can be narrowed to increase the velocity of the flow therethrough to a level which can be accurately measured. Various types of flow sensors, in addition to or instead of those described, can be utilized in this system.

Figure 11:
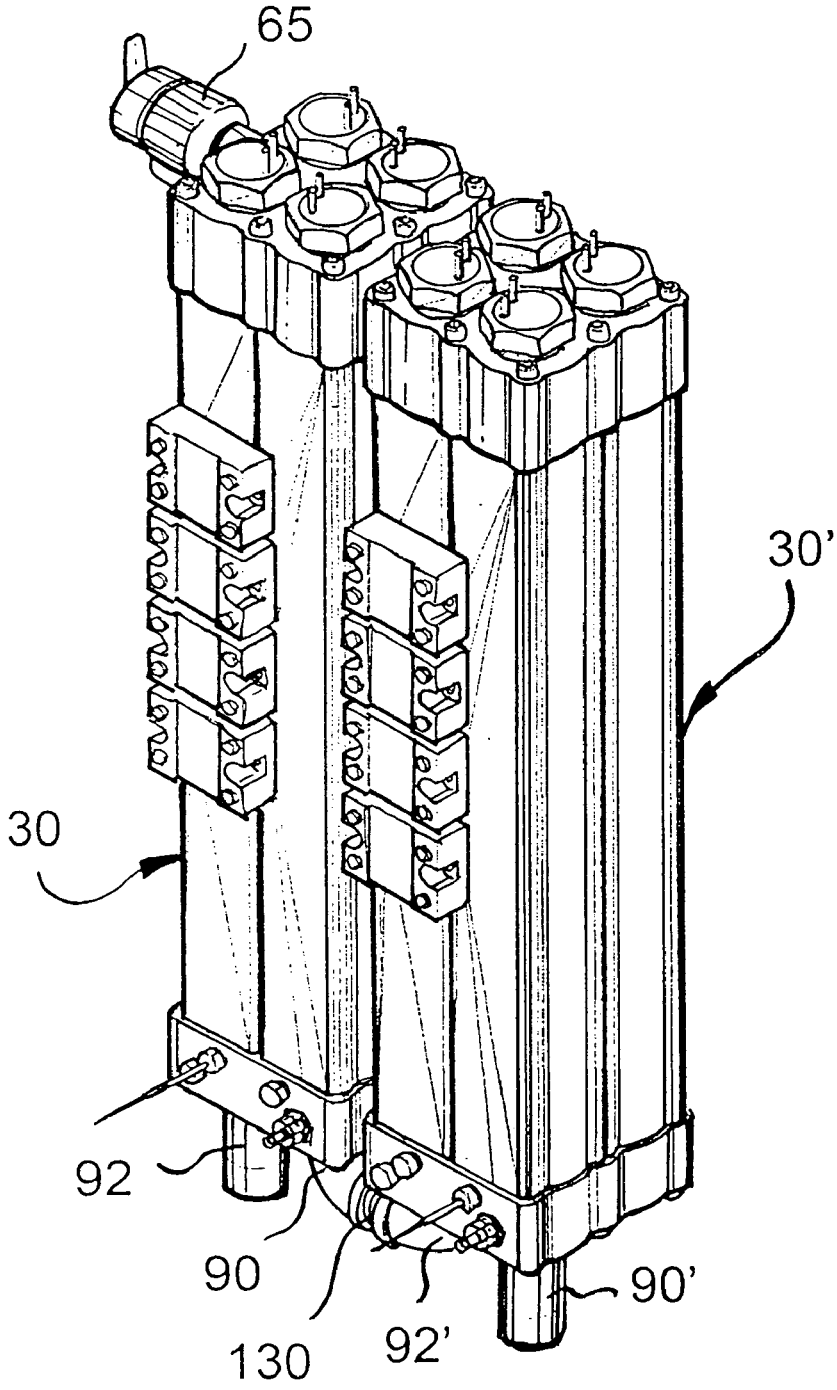
FIG. 11 is a perspective view of a pair of water heater modules coupled in series.

As briefly touched upon previously, tankless water heater system 10 can be expanded to increase its capacity by including multiple water heater modules 30. Referring to FIG. 11, a pair of water heater modules 30 can be coupled in parallel, but are preferably coupled in series, preferably using reverse return techniques. As can be seen, each of the modules is identical and therefore interchangeable to provide a modular, expandable system. For purposes of this description, reference numerals will be modified with a prime for the additional module. Water heater module 30 is generally identical to that described previously in FIG. 4 with water inlet 90 coupled to water outlet 92' of water heater module 30'. Water heater 30' is substantially identical to water heater module 30. A water supply inlet 90' is coupled to water heater module 30'. Thus, water enters water heater module 30' through port 55*a*', flows through the conduits as previously described and exits water heater module 30' through port 55*d*'. Water exiting water heater module 30' enters into coupling conduit 130 coupling water outlet 92' to water inlet 90. Water flows through the conduits as previously described and exits water heater module 30 through port 55*d*. Adding additional modules expands the capacity of system 10 to heat water. An expandable system can include housing 12 having the capacity to receive one or more additional water heater modules 30 with the ability to add corresponding terminal and breaker switch combinations 25 or an expanded housing can be added when the additional water heater modules are added. As explained below, this addition generally does not require a new controller 50.

While controller 50 is employed with a water heater module 30 in the present embodiment, one skilled in the art will understand that controller 50 can also be employed with other water heater systems and tankless systems, such as those employing water heater chambers which for purposes of this disclosure can also be referred to as conduits, coupled in series, each having a heating element associated therewith. These chambers/conduits are individual elements coupled in series by piping as opposed to a unitary modular element.

Figure 12:
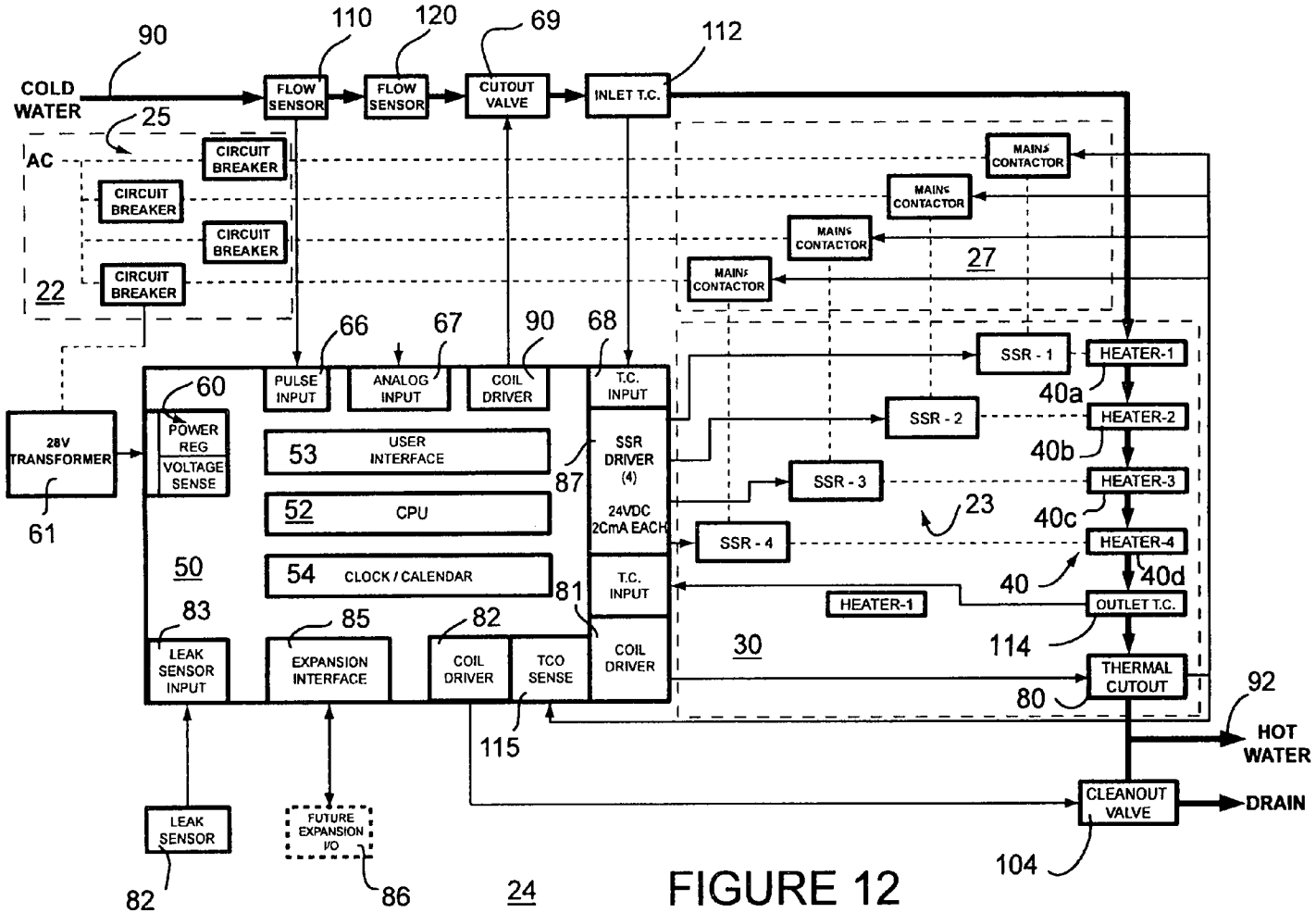
FIG. 12 is a block/schematic representation of water heater control circuitry coupled to the tankless water heater system according to the present invention.

Turning now to FIG. 12, a block/schematic representation is illustrated of control circuitry 24 coupled to the tankless water heater system 10 according to the present invention. In this description control circuitry 24 includes power module 22, mechanical relays 27, electrical components (e.g. solid state relays 23 and heating elements 40, and a controller 50), as well as all of the sensing and other control components. Controller 50 includes a central processing unit (CPU) 52, a user interface 53 that allows some control of the various functions, a clock/calendar 54 for various timing requirements, and all of the sensing and driver circuits that perform the various functions and provide the data for determing whether functions need to be performed and/or are completed. Controller 50 provides the major control for operation of the control circuitry and is programmed, by means of programs stored in internal memory in a well known fashion, to perform the various functions described in more detail below.

Some of the sensing and driver circuits that are in or associated with controller 50 include a power regulator and voltage sensor 60 that is connected through a 28 volt transformer 61 to power module 22, a pulse input 66 that receives signals from flow sensor 110, an analog input 67 that receives analog signals from flow sensor 120 (if present), and a temperature control input 68 that receives inlet temperature from inlet temperature sensor 112. Flow sensor 110, flow sensor 120, and inlet temperature sensor 112 are all serially connected into cold water inlet line 90 in series with heaters 40*a* through 40*d*. Also, optionally, serially connected in cold water inlet line 90 is a cutout valve 69 that is controlled and driven by a coil driver 70 illustrated as a portion of controller 50. A thermal cutout switch 80 is serially connected in the hot water outlet line 92 (also in series with heaters 40*a* through 40*d*) and is controlled and driven by a coil driver 81 illustrated as a portion of controller 50.

In this embodiment, a coil driver 82, illustrated as a portion of controller 50, is connected to drive cleanout valve 104. The clean out process can be initiated automatically at predetermined times (generally determined by noting accumulated materials over a period of usage) through steps programmed into CPU 52. When the cleaning process is occuring, power will be interupted to heating elements 40 by CPU 52. As described briefly above, the cleaning process can be performed manually either by including a manually and automatically operable cleanout valve 104 or by only including a manually operable cleanout valve 104. In any case, water heater module 30 is cleaned by operating cleanout valve 104 and draining (flushing) water from the bottom to an external drain.

A drip/leak sensor 82, located at the bottom of water heater module 30, is connected to a leak sensor input 83, illustrated as a portion of controller 50. If water is present, as sensed by drip/leak sensor 82, power to heaters 40 will be automatically removed by CPU 52. If an automatic cutout valve (e.g. cutout valve 69) is included in controller 50, the valve will be operated by CPU 52 to disrupt the incoming flow of cold water.

Also included in controller 50 is an expansion interface 85 included for future expansion of the system. As described, controller 50 includes software stored in non-volatile memory (not illustrated) that programs CPU 52 to run a specific heating operation or program. If the program needs to be updated by changing circumstances or by an increase in heaters, etc., a programming device can be attached to controller 50, through a future expansion I/O 86 connected to expansion interface 85, and a new program can be uploaded. Generally, no integrated circuits need to be replaced for this process, which lowers the cost of upgrading control cicuit 24. However, if determined to be preferrable, replacement of the integrated circuitry is a viable option.

Controller 50 further includes four drivers, designated 87, electrically connected to solid-state relay switches 23*a*, 23*b*, 23*c*, and 23*d*. In this embodiment each of the four drivers 87 is a 24 volt DC 20 mA driver controlled by CPU 52. To ensure the correct heat for the most efficient power usage, when a heating cycle begins, a single one of heating elements 40*a*, 40*b*, 40*c*, or 40*d* is brought on initially, followed by another and another until all of the heaters are on. In this process the initial heater experiences more use than the other heaters and, therefore, to ensure all heaters are used evenly, the heater selected to begin a cycle rotates through the four heating elements 40*a*, 40*b*, 40*c*, and 40*d*. In this embodiment, controller 50 is programmed to change or alternate the staring heating element each time a heating cycle begins. It will be understood, however, that a power use (e.g. the amount of power applied, length of time applied, etc.) counting or monitoring process could be incorporated into the software of CPU 52 so that heating elements 40*a*, 40*b*, 40*c*, and 40*d* are cycled in an order that distributes usage evenly.

Referring additionally to FIG. 13, a chart is illustrated that describes a preferred mode of power application to the four heating elements 40*a*, 40*b*, 40*c*, and 40*d*. Each time a heating cycle begins, one heater is selected (individually) to start the process, which in FIG. 13 is heating element 40*a*. It will be understood that for the next heating cycle heating element 40*b* will be the starting heater and so on through heating elements 40*c* and 40*d*. Power to heating element 40*a* is increased to about 75% full power in increments of 12.50% (see steps 0 through 6). When more heat is required from this point, heating element 40*a* remains at 75% full power and heating element 40*b* is brought on at the lowest power level (e.g. 12.50%). As more heat is required, power to heating element 40*b* is increased in increments of 12.50% until it reaches 75% full power. If still more heat is required heating elements 40*a* and 40*b* remain at 75% full power and heating element 40*c* is brought on at the lowest power level (e.g. 12.50%). As more heat is required, power to heating element 40*c* is increased in increments of 12.50% until it reaches 75% full power. If still more heat is required heating elements 40*a*, 40*b*, and 40*c* remain at 75% full power and heating element 40*d* is brought on at the lowest power level (e.g. 12.50%). As more heat is required, power to heating element 40*d* is increased in increments of 12.50% until it reaches 75% full power. For purposes of better understanding this disclosure but not for limitations of the scope of the invention, step 1 of the chart can be considered an example of a 'first heat required', step 6 can be considered an example of a 'second heat required', step 12 can be considered an example of a 'third heat required', step 18 can be considered an example of a 'fourth heat required', and step 24 can be considered an example of a 'fifth heat required'.

At this time all four heating elements 40*a*, 40*b*, 40*c*, and 40*d* are operating at 75% full power (see step 24 in FIG. 13). If additional heat is required at this point each heating element is incremented one level, starting with heating element 40*a* (steps 25 through 28), until all four heating elements 40*a*, 40*b*, 40*c*, and 40*d* are operating at 87.50% full power. For additional heat, each heating element is incremented another level, starting with heating element 40*a* (steps 29 through 32), until all four heating elements 40*a*, 40*b*, 40*c*, and 40*d* are operating at 100% full power. Thus, through this novel system of incrementing the four heaters from zero power to full power thirty two increments of heat are provided. It will be understood by those skilled in the art that a different number of heaters and/or different increments of power will provide more or less increments of heat and the disclosed number of heaters and size of increments is for purposes of explanation. By providing a number of increments of heat (i.e. power), the system operates more efficiently because only the exact heat required is provided.

In addition to the incrementing of power described above, controller 50 uses a unique form of synchronous AC power control. The synchronous power control involves switching power to heating elements 40 through 40*d*, off or on, at the exact time that the AC voltage passes through zero volts (zero crossing). Also, CPU 52 determines the shortest number of power cycles that can implement the desired power level. Whereas, existing water heaters utilize power control that turns on power to the heaters for some portion of a fixed number of power cycles. The present novel system more evenly averages power usage and minimizes disturbances to other equipment attached to the power source.

Tankless water heater 10 can also be programmed to operate in an economy mode. In this mode the maximum power delivered to heating elements 40*a* through 40*d* is limited (e.g. 87.50% or even 75%). Full temperature can be attained in this mode by reducing the water flow, which can be achieved, for example, by including a controllable valve in the water inlet line. In many markets, energy costs change for some time periods of the day or week. Thus, for such situations, tankless water heater 10 can be automatically switched into the economy mode of operation. For example, week days can be broken into four time periods with each period having a predetermined power mode. Weekends can have a different power mode, depending upon the specific requirements determined by the owner/operator.

In the present embodiment, CPU 52 includes in its program steps for monitoring the heating efficiency. Heating elements can fail to produce heat, at which point the failed heating elememnt needs to be replaced. If, for example, a dramatic reduction in efficiency is detected, controller 50 will enter a special test mode to discover the failed heating element. In the special test mode, CPU 52 activates each heating element 40 through 40*d* individually and looks for a temperature rise. If a temperature rise is not sensed, the heating element being activated will be determined to be failed and will no longer be used. A light or other indicator can be used to warn an operator of the failure.

Similarly, controller 50 can include a program for detecting a faulty thermal sensor 114. If heating circuits are energized. A temperature rise is expected. Thus, a thermal sensor testing mode can be incorporated into the program of CPU 52. If, for example, a heating element is activated and no rise in temperature is detected, the thermal sensor test mode will be activated. In this mode, CPU 52 activates the heating elements 40*a* through 40*d* and looks for a temperature rise. If no rise is detected, the unresponsive temperature sensor will be noted as failed.

In still a further safety mode of operation, controller 50 can monitor the amount of water flowing through tankless water heater 10 in each single use. Controller 50 can be set to allow a limited or predetermined maximum volume to flow or limit the time of operation to a prescribed period of time. After the maximum volume of water has flowed through tankless water heater 10, heating will be disabled. Also, an automatic shutoff valve (e.g. cutout valve 69) can be installed and will be controlled to disrupt incoming water when the maximum volume has been reached. Thus, when faucets are inadvertently left on or breaks or other failures occur, water flow can be stopped, rather than continue to flow.

Outlet temperature sensor 114, or an additional sensor, can also sense the heating chamber temperature and when the outlet temperature exceeds a safe level (generally a temperature near the thermal cutout temperature) CPU 52 interrupts power to heating circuits 40*a* through 40*d*. If the thermal cutout temperature is actually reached, thermal cutout valve 80 is operated by CPU 52 to prevent the overheated water from flowing. Also, if cutout valve 69 is an automatic valve it may be operated by CPU 52 at this time to disrupt incoming water. Further, controller 50 continuously monitors the heating chamber temperature since for example, if the heater freezes the water it contains will expand and may burst the heating chamber. If the temperature comes close to freezing, a brief heating cycle will be activated by CPU 52 to prevent the heating chamber from freezing. One further feature that can be incorporated is an ultraviolet purification system. While water is flowing through the heating chamber the ultraviolet purification system can be activated by CPU 52 to purify the water as it flows through the system.

Thus, a new and improved tankless water heater controller is disclosed that heats water very accurately and efficiently as it is needed. Since only the amount of water needed is heated and since the temperature is closely controlled the system is very efficient. Further, a plurality of safety features are incorporated to ensure safe operation as well as safe use of the water. The new and improved control circuitry for tankless water heaters more closely controls the temperature of the water during usage. Also, the new and improved control circuitry for tankless water heaters more closely provides a desired amount of water at a desired temperature.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. Control circuitry for a tankless water heater system, the tankless water heater system including a plurality of water conduits connected in series, the series connection being further connectable to a cold water supply and to provide a heated water flow to a heated water demand site, the control circuitry comprising:

a plurality of water heater elements, one each associated with each of the plurality of water conduits;

a controller including a central processing unit with an operating program;

a plurality of sensors positioned in the water flow and electrically coupled to the controller, at least one of the plurality of sensors providing an indication of the water temperature in an outlet of the series connection;

connecting and operating circuitry coupling each of the plurality of water heater elements to the central processing unit; and the central processing unit being programmed to control the connecting and operating circuitry in accordance with indications from the plurality of sensors to individually and sequentially activate a first of the plurality of water heater elements in predetermined steps to a middle power level of the first water heater element less than a maximum power level of the first water heater element, activate a second of the plurality of water heater elements in predetermined steps to a middle power level of the second water heater element less than a maximum power level of the second water heater element, and activate the first water heater element from the middle power level of the first water heater element to the maximum power level of the first water heater element and then activate the second water heater element from the middle power level of the second water heater element to the maximum power level of the second water heater element in response to a demand for heated water, the number of the plurality of water heater elements sequentially activated and the sequential power level of the activation being determined by the demand for heated water.

2. Control circuitry as claimed in claim 1 wherein the operating program includes a predetermined schedule for activating additional ones of the plurality of water heater elements, in accordance with the sequential activation of the first and second water heater elements, as heat required for the demand for heated water increases.

3. Control circuitry as claimed in claim 2 wherein the operating program includes a predetermined schedule for activating additional ones of the plurality of water heater elements to additional power levels as heat required for the demand for heated water increases.

4. Control circuitry as claimed in claim 3 wherein, in accordance with the predetermined schedule, a first water heater element of the plurality of water heater elements is sequentially activated up to the middle power level of the first water heater element less than the maximum power level of the first water heater element for a first heat required, a second water heater element of the plurality of water heater elements is sequentially activated up to the middle power level of the second water heater element less than the maximum power level of the second water heater element for a second heat required higher than the first heat required, a third water heater element of the plurality of water heater elements is sequentially activated up to a middle power level of the third water heater element less than a maximum power level of the third water heater element for a third heat required higher than the second heat required, and a fourth water heater element of the plurality of water heater elements is sequentially activated up to a middle power level of the fourth water heater element less than a maximum power level of the fourth water heater element for a fourth heat required higher than the third heat required.

5. Control circuitry as claimed in claim 4 wherein the first water heater element is activated for the first heat required to a first power level, and for heat requirements greater than the first heat required and less than the second heat required the power level of the first water heater element is increased in predetermined increments.

6. Control circuitry as claimed in claim 5 wherein the second water heater element is activated for the second heat required to the first power level and for heat required greater than the second heat required and less than the third heat required the power level of the second water heater element is increased in predetermined increments.

7. Control circuitry as claimed in claim 6 wherein the third water heater element is activated for the third heat required to the first power level and for heat required greater than the third heat required and less than the fourth heat required the power level of the third water heater element is increased in predetermined increments.

8. Control circuitry as claimed in claim 7 wherein the fourth water heater element is activated for the fourth heat required to the first power level and for heat required greater than the fourth heat required and less than a maximum heat required the power level of the fourth water heater element is increased in predetermined increments.

9. Control circuitry as claimed in claim 8 wherein the first water heater element, the second water heater element, the third water heater element, and the fourth water heater element are cycled among the plurality of water heater elements by the controller.

10. Control circuitry as claimed in claim 8 wherein the first power level is approximately 12.50% of full power.

11. Control circuitry as claimed in claim 8 wherein the predetermined increments are approximately 12.50% of full power.

12. Control circuitry for a tankless water heater system, the tankless water heater system including a water heater module with four water conduits connected in series, the series connection being further connectable to a cold water supply and to provide a heated water flow to a heated water demand site, the control circuitry comprising:

four water heater elements, one each associated with each of the plurality of water conduits;

a controller including a central processing unit programmed with an operating program;

a plurality of sensors positioned in the water flow and electrically coupled to the controller, at least one of the plurality of sensors providing an indication of the water temperature in an outlet of the series connection;

connecting and operating circuitry coupling each of the plurality of water heater elements to the central processing unit; and the central processing unit being programmed to control the connecting and operating circuitry in accordance with indications from the plurality of sensors to individually activate a first water heater element to a first power level for a first heat required in response to a demand for heated water, and for heat required greater than the first heat required and less than a second heat required in response to a demand for heated water the central processing unit increases the power level of the first water heater element in predetermined increments up to a mid-power level less than a maximum power level of the first water heater element;

the central processing unit being programmed to control the connecting and operating circuitry in accordance with indications from the plurality of sensors to individually activate a second water heater element of the four water heating elements to the first power level for the second heat required, and for heat required greater than the second heat required and less than a third heat required in response to a demand for heated water the central processing unit increases the power level of the second water heater element in predetermined increments up to a mid-power level less than a maximum power level of the second water heater element;

the central processing unit being programmed to control the connecting and operating circuitry in accordance with indications from the plurality of sensors to individually activate a third water heater element of the four water heater elements to the first power level for the third heat required, and for heat required greater than the third heat required and less than a fourth heat required in response to a demand for heated water the central processing unit increases the power level of the third water heater element in predetermined increments up to a mid-power level less than a maximum power level of the third water heater element; and the central processing unit being programmed to control the connecting and operating circuitry in accordance with indications from the plurality of sensors to individually activate a fourth water heater element of the four water heater elements to the first power level for the fourth heat required, and for heat required greater than the fourth heat required and less than a fifth heat required in response to a demand for heated water the central processing unit increases the power level of the fourth water heater element in predetermined increments up to a mid-power level less than a maximum power level of the fourth water heater element.

13. Control circuitry as claimed in claim 12 wherein the first water heater element, the second water heater element, the third water heater element, and the fourth water heater element are cycled among the plurality of water heater elements by the controller.

14. Control circuitry as claimed in claim 12 wherein the first power level is approximately 12.50% of full power.

15. Control circuitry as claimed in claim 12 wherein the predetermined increments are approximately 12.50% of full power.

16. A method of controlling a tankless water heater system that includes a plurality of water conduits connected in series, the series connection being further connected to a cold water supply and to provide a heated water flow to a heated water demand site, the method comprising the steps of:

providing a plurality of water heater elements, one each associated with each of the plurality of water conduits;

providing a controller including a central processing unit programmed with an operating program, and coupling each of the plurality of water heater elements to the central processing unit, the operating program including the sequential steps of activating a first of the plurality of water heater elements in predetermined steps to a mid-power level of the first water heater element less than a maximum power level of the first water heater element, activating a second of the plurality of water heater elements in predetermined steps to a mid-power level of the second water heater element less than a maximum power level of the second water heater element, and activating the first water heater element from the mid-power level of the first water heater element to the maximum power level of the first water heater element and then activating the second water heater element from the mid-power level of the second water heater element to the maximum power level of the second water heater element;

positioning a plurality of sensors in the water flow and electrically coupling the sensors to the controller, using at least one of the plurality of sensors as an indication of the water temperature in an outlet of the series connection;

using the central processing unit individually activating the plurality of water heater elements to a predetermined power level, in accordance with the sequential steps of the operating program, in response to a demand for heated water, and using the operating program of the central processing unit determining the number of the plurality of water heater elements to activate and the power level of the activation by the demand for heated water.

17. A method as claimed in claim 16 wherein the step of providing the controller including the central processing unit programmed with the operating program includes programming a predetermined schedule for activating additional ones of the plurality of water heater elements as heat required for the demand for heated water increases.

18. A method as claimed in claim 16 wherein the step of providing the controller including the central processing unit programmed with the operating program includes programming a predetermined schedule for activating additional ones of the plurality of water heater elements to additional power levels as heat required for the demand for heated water increases.

19. A method as claimed in claim 18 wherein the operating program includes activating the first water heater element of the plurality of water heater elements for a first heat required, the second water heater element of the plurality of water heater elements for a second heat required higher than the first heat required, a third water heater element of the plurality of water heater elements for a third heat required higher than the second heat required, and a fourth water heater element of the plurality of water heater elements for a fourth heat required higher than the third heat required.

20. A method as claimed in claim 19 wherein the program includes activating the first water heater element for the first heat required to a first power level and for heat requirements greater than the first heat required and less than the second heat required increasing the power level of the first water heater element in predetermined increments.

21. A method as claimed in claim 20 wherein the program includes activating the second water heater element for the second heat required to the first power level and for heat required greater than the second heat required and less than the third heat required increasing the power level of the second water heater element in predetermined increments.

22. A method as claimed in claim 21 wherein the program includes activating the third water heater element for the third heat required to the first power level and for heat required greater than the third heat required and less than the fourth heat required increasing the power level of the third water heater element in predetermined increments.

23. A method as claimed in claim 22 wherein the program includes activating the fourth water heater element for the fourth heat required to the first power level and for heat required greater than the fourth heat required and less than a maximum heat required increasing the power level of the fourth water heater element in predetermined increments.

24. A method as claimed in claim 23 wherein the program cycles the activation of the first water heater element, the second water heater element, the third water heater element, and the fourth water heater element among the plurality of water heater elements.

* * * * *